United States Patent [19]

Maeno et al.

[11] Patent Number: 4,947,209

[45] Date of Patent: Aug. 7, 1990

[54] COPYING MACHINE CONTROL APPARATUS

[75] Inventors: Satoru Maeno; Norio Fukuyama; Tetsuo Ohishi, all of Ise, Japan

[73] Assignee: Shinko Electric Co., Ltd., Tokyo, Japan

[21] Appl. No.: 351,766

[22] Filed: May 15, 1989

[30] Foreign Application Priority Data

May 18, 1988 [JP] Japan ..... 63-121483

[51] Int. Cl.[5] ..... G03G 15/00

[52] U.S. Cl. ..... 355/204; 355/203; 355/207; 355/208

[58] Field of Search ..... 355/203, 204, 208, 207, 355/233, 235, 243

[56] References Cited

U.S. PATENT DOCUMENTS

| | | | |
|---|---|---|---|
| 4,183,656 | 1/1980 | Ishihara et al. | 355/203 X |
| 4,335,949 | 6/1982 | Kukucka et al. | 355/203 X |
| 4,391,506 | 7/1983 | Koide | 355/235 |
| 4,426,149 | 1/1984 | Kuemmel et al. | 355/235 |
| 4,586,808 | 5/1986 | Tanimoto et al. | 355/204 X |
| 4,678,315 | 7/1987 | Watanabe | 355/218 |
| 4,796,054 | 1/1989 | Maeno et al. | 355/243 |

FOREIGN PATENT DOCUMENTS

| | | |
|---|---|---|
| 259839 | 3/1988 | European Pat. Off. . |
| 272517 | 6/1988 | European Pat. Off. . |

*Primary Examiner*—A. C. Prescott

*Attorney, Agent, or Firm*—Scully, Scott, Murphy & Presser

[57] ABSTRACT

A copying machine control apparatus which includes a first control means for actuating a first driving means which operates a photoconductive drum, a second control means for actuating a second driving means which operates a scanning means, and a third control means for actuating a third driving means which operates a transfer drum. Each of first, second, and third control means has a position controller and a speed controller, respectively, operated by a common reference pulse train, in which the position controller generates a position control signal to indicate the turning position difference at any moment, and the speed controller generates a speed control signal which is composed of a frequency difference between the common reference pulse train and the pulse train outputted from respective pulse encoders, then this speed control signal is added to the position control signal to generate a driving signal which actuates each of first, second, and third driving means, respectively. Thus, the first, second, and third driving means are harmoniously operated by the common reference pulse train. In the case where each of the first and third driving means is constructed by an outer-rotor type electric motor, each of the photoconductive and transfer drum is rotated by the outer rotor of the electric motor.

4 Claims, 4 Drawing Sheets

COPYING MACHINE CONTROL APPARATUS

BACKGROUND OF THE INVENTION

1. Field of the invention

The present invention relates to a copying machine control apparatus, and more particularly to a improved copying machine control apparatus which can eliminate unwanted elongation, shortening, or misalignment of the copied product.

2. Prior Art

The conventional color copying machine generally comprises a light source, movable mirrors, a photoconductive drum, and a transfer drum. These components are accurately driven in accordance with a predetermined timing to form an original on a record sheet.

FIG. 1 is a diagrammatic illustration showing the construction of a conventional color copying machine. The color copying machine has frame 1, the upper portion of which is provided with platen 2 for placing an original thereon. Scanning unit 3 is arranged below platen 2, and it includes elongated lamp 4, first and second mirrors 5 and 6, a filter-and-lens unit 7, and third and fourth mirrors 8 and 9. Lamp 4 is mounted on frame 1 so as to move in a linear to and from direction with first mirror 5, as indicated by arrows A and B in FIG. 1. Second mirror 6 is arranged so as to move in accordance with movement of lamp 4 and first mirror 5 at a speed which is half the speed of the movement of lamp 4 and first mirror 5.

During operation, lamp 4 and first mirror 5 are moved in the direction indicated by arrow A. As a result, an outer peripheral surface of photoconductive drum 10 is exposed to a beam of light which forms an image on platen 2. In this case, filter-and-lens unit 7 has been changed over so that it passes on components of the light other than the yellow component. Photoconductive drum 10 has also been electrically charged by charging device 11. Therefore, an electrostatic latent image corresponding to the yellow component of the image on the original is formed on the peripheral surface of photoconductive drum 10. A yellow toner is then allowed to adhere to the electrostatic latent image on photoconductive drum 10 by first developing device 12, so that a yellow toner image is formed on the peripheral surface of photoconductive drum 10.

A record sheet is fed from record-sheet trays 13 or 14 and is wrapped around transfer drum 15, and fed to a transfer position T where the record sheet is fastened by gripper 16. By transferring the record sheet to copying position T, the front edge of the record sheet is aligned with that of the yellow toner image. Then, the image begins transferring the yellow toner image on photoconductive drum 10 is transferred to the record sheet on transfer drum 15. At this time, the peripheral velocity of photoconductive drum 10 is equal to that of transfer drum 15. The peripheral surface of photoconductive drum 10 is in turn cleaned by cleaning device 17 while the copy is being finished.

Accordingly, when the transfer of the entire yellow toner image to the record sheet is completed, filter-and-lens unit 7 is changed over so that it passes color components of the light other than the magenta component. At the same time, second developing device 18 for the magenta color is selected, and another transfer operation is carried out in the manner described for the yellow toner image. Then, filter-and-lens unit 7 is again changed over so that it passes color components of the light other than the cyan component, and third developing device 19 is selected. Further transfer operations are carried out in the same manner. Thus, the toner images of the three primary colors yellow, magenta and cyan are applied to the surface of the record sheet, which is wrapped around transfer drum 15, to form color images.

The record sheet on transfer drum 15 is then fed by endless belt 20 to fixing device 21 at which the color image formed on the record sheet is fixed thereto. When the fixin operation is completed, the record sheet is discharged to tray 22, terminating the copying operation.

FIG. 2 shows the brief drive layout of a color copying machine control apparatus. In this drawing, numeral 31 designates an electric motor for driving photoconductive drum 10, while numeral 32 designates another electric motor for driving transfer drum 15. The rotations of respective motor shafts 31*a* and 32*a* rotate respective shafts 10*a* and 15*a* through couplings 33 and 34. Shafts 31*a* and 32*a* are extended from photoconductive drum 10 and transfer drum 15, respectively. Electric motor 31 has pulse encoder 35, while electric motor 32 has pulse encoder 36. Both pulse encoders 35 and 36 generate pulse trains Pl and P3 in response to the rotation of respective electric motors 31 and 32 to output to respective down-count terminals D of counters 37*a* and 38*a*. These counters 37*a* and 38*a* are incorporated in controllers 37 and 38, respectively. Controllers 37 and 38 are described later.

Numeral 39 designates an electric motor for moving scanning unit 3, in which motor shaft 39*a* rotates pulley shaft 41 to move elongated lamp 4 and the like in a linear to and fro movement. Electric motor 39 has pulse encoder 42 to generate pulse train P2 in response to the rotation thereof and output pulse train P2 to down-count terminal D of counter 43*a* which is incorporated in controller 43.

Controller 37 controls the rotation of electric motor 31 so that the rotation speed of photoconductive drum 10 is equal to the rotation speed which is indicated by reference pulse train CM1 outputted from reference signal generator 44. That is, reference signal generator 44 supplies reference pulse train CM1 having a predetermined frequency to up-count terminal U of counter 37*a* which is incorporated in controller 37. In addition, controller 37 controls the rotation of electric motor 31 so that the frequency of pulse train Pl outputted from pulse encoder 35 to down-count terminal D, is equal to the frequency of reference pulse train CM1. Thus, the rotation speed of electric motor 31 is made equal to the rotation speed which is indicated by reference pulse train CM1.

Controller 38 controls the rotation speed of transfer drum 15 based on the frequency difference between reference pulse train CM3 supplied to up-count terminal U of counter 38*a* and pulse train P3 outputted from pulse encoder 36 while controller 43 controls the movement speed of scanning unit 3 based on the frequency difference between reference pulse train CM2 supplied to up-count terminal U of counter 43*a* and pulse train P2 outputted from pulse encoder 42. Thus, pulse train Pl outputted from pulse encoder 35 is used as reference pulse trains CM3 and CM2 to synchronize the rotation of photoconductive drum 10 with the rotation of transfer 15 and the movement of scanning unit 3.

The load of photoconductive drum 10 varies with its condition when the outer peripheral surface contacts one of the first developing device 12, second developing device 18, or third developing device 19, or when it is separated from them. This causes the peripheral speed of photoconductive drum 10 to vary transiently during rotation. In the case where the movement speed of scanning unit 3 is constant, when the peripheral speed of photoconductive drum 10 is relatively lower than the movement speed of scanning unit 3, the toner image formed o photoconductive drum 10 is elongated. Conversely, the image is shortened when the peripheral speed of photoconductive drum 10 is higher than that of scanning unit 3. Furthermore, out of synchronization peripheral speed between transfer drum 15 and photoconductive drum 10 causes misalignment of colors.

In order to prevent the elongation or shortening of the toner image, and misalignment of colors, as described above, pulse train P1 is commonly used as reference pulse trains CM3 and CM2. That is, in controller 38, the use of pulse train Pl synchronizes the rotation of transfer drum 15 with the rotation of photoconductive drum 10 so that the rotation speed of electric motor 31 is followed by that of electric motor 32. In controller 43, pulse train Pl is used as reference pulse train CM2 to synchronize the movement speed of scanning unit 3 with the rotation speed of photoconductive drum 10. At this time, scanning unit 3 in copying mode, moves in the direction of arrow A shown in FIG. 2, when changing switch 45 to position "F" by rotating direction signal F/R. On the other hand, when changing switch 45 to position "R" by rotating direction signal F/R, pulse train P4 as reference pulse train CM2 is supplied to controller 43 from reference signal generator 46 to rapidly return scanning unit 3 to the starting position because the frequency of pulse train P4 is higher than that of reference pulse train CM1.

However, pulse train P1 (as reference pulse trains CM3 and CM2) controls the rotation of electric motors 32 and 39, in which electric motor 32 rotates transfer drum 15 and electric motor 39 drives scanning unit 3 in a linear to and fro movement, so that controllers 38 and 43 respond to electric motor 31 through pulse encoder 35 with a time delay, thus the operation of transfer drum 15 and scanning unit 3 has a time delay in response to the speed variation of photoconductive drum 10.

Photoconductive drum 10 is usually made of aluminum or other such light materials, so that the inertia is relatively small, thus speed variation is large when contacting or disengaging photoconductive drum 10 and one of the developing devices 12, 18 and 19.

According to the above two paragraphs, problems remain such as the elongation or shortening of the toner image, and misalignment of color on photoconductive drum 10.

These problems occur not only in the above copying machine, but also in a copying machine which comprises a single developing device without a transfer drum which is a so-called monochromic-type copying machine.

Furthermore, in the case of a conventional color copying machine, the coupling portion between electric motor 32 and transfer drum 15 or the linkage comprises coupling 34, shaft 32*a*, and shaft 15*a*, and has a relatively low torsional rigidity, so that a torsional vibration is produced when increasing or decreasing the rotation speed of transfer drum 15. Thus, in FIG. 3, the rotation speed of transfer drum 15 changes in response to torsional vibration during copying mode, and therefore the front edge of the record sheet is not aligned with the front edge of the toner image.

SUMMARY OF THE INVENTION

It is accordingly an object of the present invention to provide a improved copying machine control apparatus which can prevent the elongation, shortening, or misalignment of the copied products when copying an original to the record sheet.

In a first aspect of the present invention, there is provided a copying machine control apparatus comprising: photoconductive drum driven rotatively by a first driving means to form an electrostatic latent image corresponding to an original; scanning means provided movably with an operation of the photoconductive drum in linear to and fro direction along the original and driven by a second driving means to apply illumination thereto; first control means for supplying a first driving signal to the first driving means, in which the first driving signal is composed of a frequency difference between first reference pulse train for actuating the first driving means and pulse train indicated by number of revolutions outputted from a first pulse encoder coupled to the first driving means; second control means for supplying a second driving signal to a second driving means to operate the scanning means in which the second driving signal is composed of a frequency difference between the first reference pulse train for actuating the second driving means and a pulse train indicated by number of revolutions outputted from a second pulse encoder coupled to the second driving means; switching means for changing the first reference pulse train to a second reference pulse train to generate the second driving signal, in which a frequency of the second reference pulse train is higher than that of the first reference pulse train; position controller provided in the first and second control means to generate a position control signal so that number of revolutions of the first and second driving means are harmonized with the first reference pulse train, in which the position control signal is composed of a deviation between a total number of the first reference pulse train and each total number of the pulse trains outputted from the first and second pulse encoders, respectively; speed controller provided in the first and second control means to generate a speed control signal which is composed of a frequency difference between a frequency of the first reference pulse train and each frequency of the pulse trains outputted from the first and second pulse encoders, respectively, and the speed controller adds the speed control signal to the position control signal to generate a driving signal which actuates the first and second driving means, respectively.

The above copying machine control apparatus is for a monochromic type copying machine.

In a second aspect of the present invention, there is provided a copying machine control apparatus comprising: photoconductive drum driven rotatively by a first driving means to form an electrostatic latent image corresponding to an original; scanning means provided movably in a linear to and fro direction along the original and driven by a second driving means to apply illumination thereto; transfer drum driven rotatively by a third driving means to receive the electrostatic image from said photoconductive drum; first control means for supplying a first driving signal to the first driving means, in which the first driving signal is composed of a frequency difference between a first reference pulse train for actuating the first driving means and a pulse train indicated by number of revolutions outputted from a first pulse encoder coupled to the first driving means; second control means for supplying a second driving signal to a second driving means to operate the scanning means, in which the second driving signal is composed of a frequency difference between the first reference pulse train of actuating the second driving means and pulse train indicated by number of revolutions outputted from a second pulse encoder coupled to the second driving means; third control means for supplying a third driving signal to a third driving means to operate the transfer drum, in which the third driving signal is composed of a frequency difference between the first reference pulse train for actuating the third driving means and a pulse train indicated by number of revolutions outputted from a third pulse encoder coupled to the third driving means; switching means for changing the first reference pulse train to second reference pulse train to generate the second driving signal, in which a frequency of the second reference pulse train is higher than that of the first reference pulse train; position controller provided in the first, second, and third control means to generate a position control signal so that number of revolutions of the first, second, and third driving means are harmonized with the first reference pulse train, in which the position control signal is composed of a deviation between a total number of the first reference pulse train and each total number of the pulse trains outputted from the first, second, and third pulse encoders, respectively; speed controller provided in the first, second, and third control means to generate a speed control signal which is composed of a frequency difference between a frequency of the first reference pulse train and each frequency of the pulse trains outputted from the first, second, and third pulse encoders, respectively, and the speed controller adds the speed control signal to the position control signal to generate a driving signal which actuates the first, second, and third driving means, respectively.

The above copying machine control apparatus is for a color type copying machine.

DESCRIPTION OF THE PREFERRED EMBODIMENT

Figure 1:
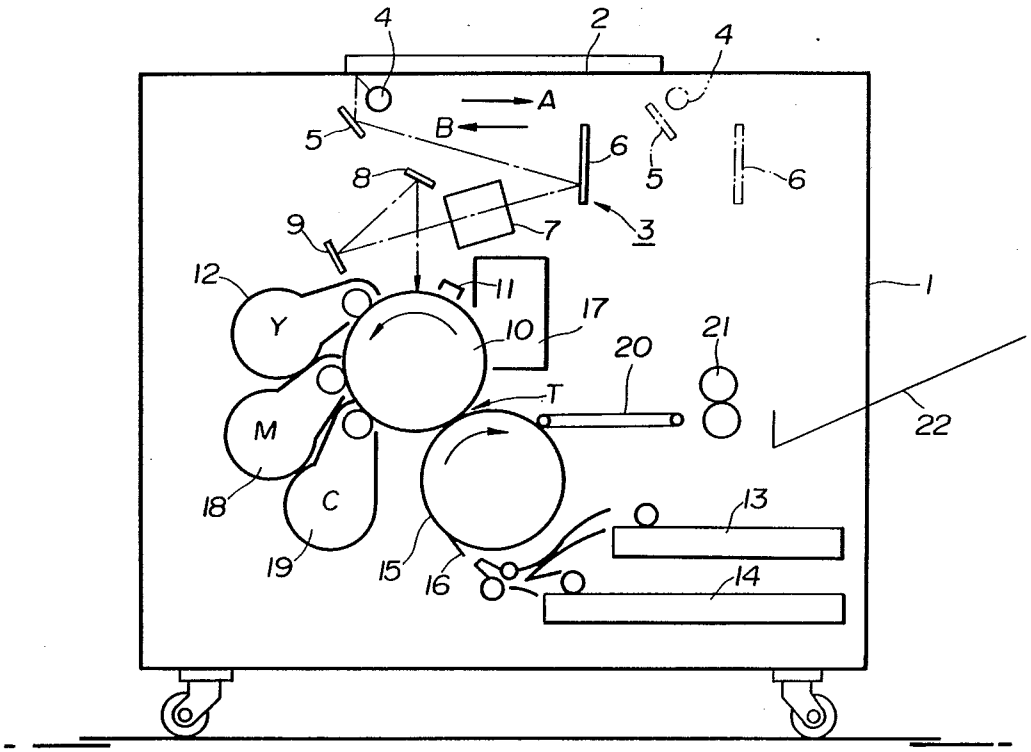
FIG. 1 (PRIOR ART)
FIG. 1 is a diagrammatic view showing a construction of the conventional color copying machine.
Figure 2:
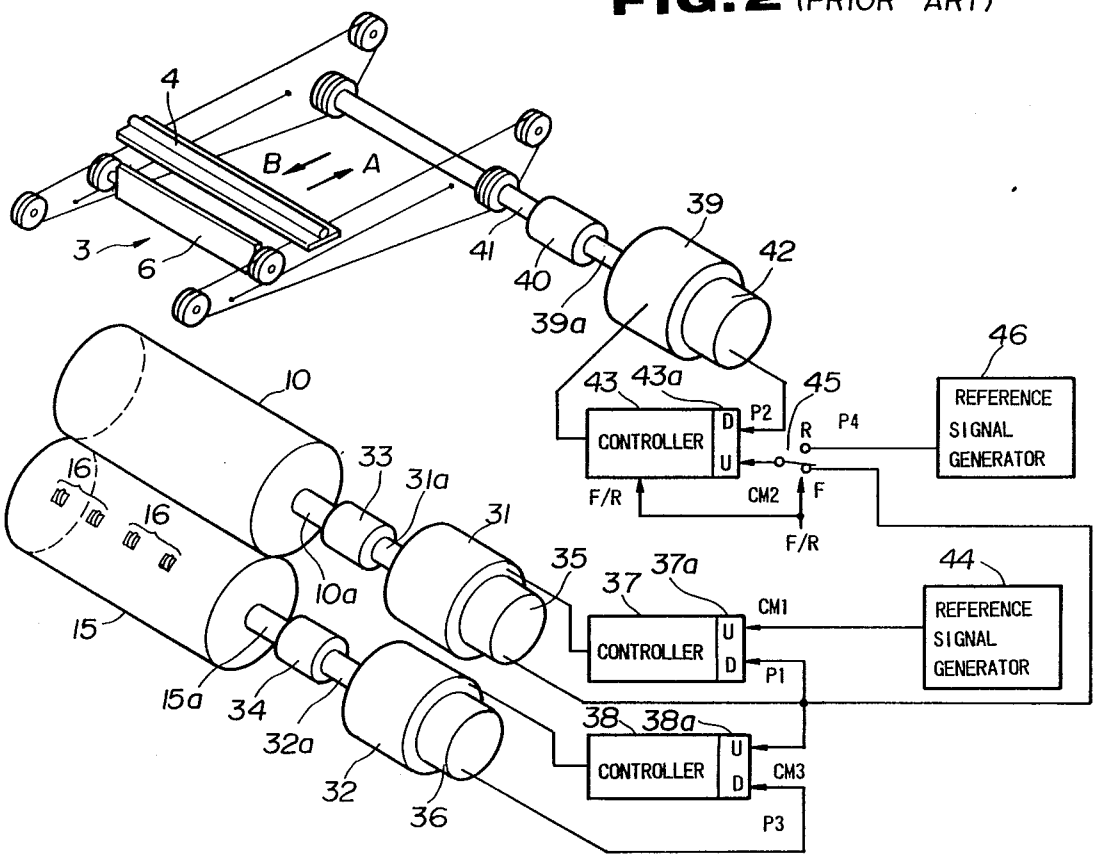
FIG. 2 (PRIOR ART)
FIG. 2 is a perspective view showing a copying machine control apparatus for the conventional color copying machine.

Hereinafter, an embodiment of the present invention is described by reference to drawings. In this embodiment, a copying machine control apparatus has a similar construction of conventional copying machine control apparatus as shown in FIG. 2. This similar construction is designated by the same reference numerals, and the details of the description are omitted for the sake of simplicity.

Figure 4:
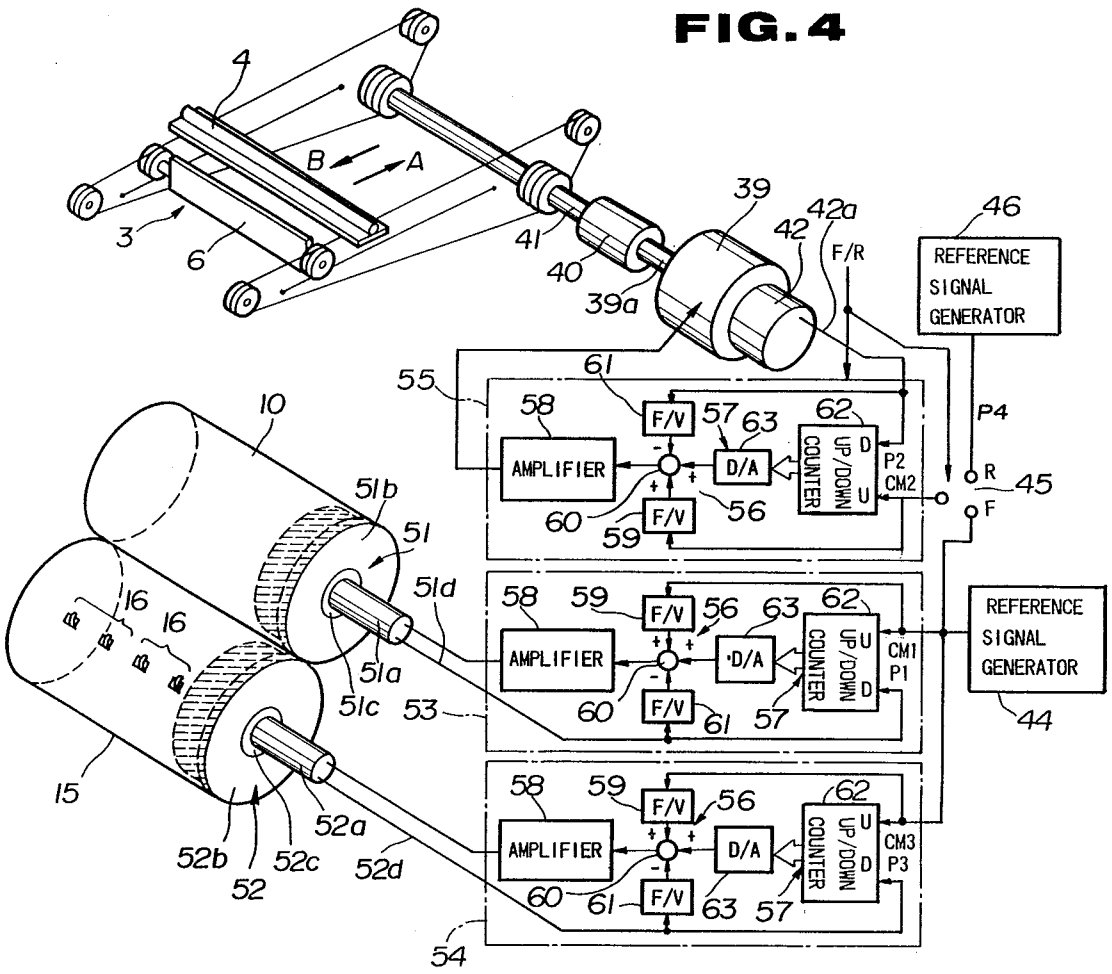
FIG. 4 is a perspective view showing a copying machine control apparatus for the color copying machine in an embodiment.

FIG. 4 shows copying machine control apparatus used for a color copying machine. In FIG. 4, numerals 51 and 52 designate electric motors for rotating photoconductive drum 10 and transfer drum 15, respectively. These electric motors 51 and 52 are of a so-called outer-rotor type which comprises a shaft which is usually in a stationary position, a stator being formed around the shaft, and an outer rotor forming in a rotor housing which is faced to the stator.

In FIG. 4, both bearings 51*c* and 52*c* are rigidly inserted on both pipe-like shafts 51*a* and 52*a*, respectively. These bearings 51*c* and 52*c* rotatively support rotor housings 51*b* and 52*b*, thus rotor housings 51*b* and 52*b* rotates about shafts 51*a* and 52*a*, respectively. Each of the outer rotors which faces the stator is incorporated in rotor housings 51*b* and 52*b*, respectively. These outer peripheral surfaces of rotor housings 51*b* and 52*b* are inserted into both cylindrical photoconductive drum 10 and transfer drum 15, then the outer peripheral surfaces thereof are fixedly attached to the inner peripheral surfaces of photoconductive drum 10 and transfer drum 15, respectively. Both shafts 51*a* and 52*a* are fixed to a frame of the color copying machine, while the other ends of photoconductive drum 10 and transfer drum 15 are rotatively supported by the frame of the color copying machine. The leads extending from the stators pass through the inside of shafts 51*a* and 52*a*, then are connected to controller 53 and 54, in which controller 53 supplies a first driving signal to the stator of electric motor 51, and controller 54 supplies a third driving signal to the stator of electric motor 52.

In addition, the pulse encoders are mounted on rotor housing 51*b* and 52*b*, respectively, to extract pulse trains therefrom, in which pulse train P1 is outputted from the pulse encoder mounted on rotor housing 51*b*, while pulse train P3 is outputted from the pulse encoder mounted on rotor housing 52*b*. Respective pulse trains P1 and P3 indicate rotation speed, and these are supplied to controller 53 and 54 through leads 51*d* and 52*d* which pass through the inside of shafts 51*a* and 52*a*, respectively.

Scanning unit 3 is a similar type as shown in FIG. 2. This scanning unit 3 is moved in the linear to and fro direction A and B as shown by the arrow when electric motor 39 rotates back and forth. Pulse encoder 42 is coupled to electric motor 39 to output pulse train P2 to controller 55 through lead 42*a*, in which pulse train P2 indicates the rotation speed of electric motor 39. Controller 55 supplies a second driving signal to electric motor 39 in response to pulse train P2.

Respective controllers 53, 54, and 55 comprise speed controller 56 and position controller 57.

In controller 53, 54, and 55, respective speed controllers 56 comprise amplifier 58, first F-V converter (frequency to voltage converter) 59, arithmetic circuit (or adder) 60, and second F-V converter 61. Respective position controllers 57 comprise counter 62 and D-A converter 63.

Up-count terminals U of counters 62 incorporated in controllers 53 and 54 are connected to reference signal generator 44, while up-count terminal U of counter 62 incorporated in controller 55 is connected to reference signal generator 44 through switch 45. Instruction signal generator 44 generates first reference pulse train CM1 which indicates a desirable rotation speed to rotate electric motors 39, 51, and 52. This first reference pulse train CM1 is supplied to up-count terminal U of counter 62 incorporated in controller 53, up-count terminal U of counter 62 incorporated in controller 54, and up-count terminal U of counter 62 incorporated in controller 55. When counter 62 in controller 54 receives first reference pulse train CM1, this first reference pulse train CM1 is designated by CM3. Similarly, in controller 53, first reference pulse train CM1 is designated by CM3, and in controller 55, designated by CM2. This renaming allows better understanding of the process compared with the conventional control apparatus shown in FIG. 2.

In controller 55, when switch 45 is positioned in "F" by rotating direction signal F/R, first reference pulse train CM1 is supplied to up-count terminal U of counter 62. This rotating direction signal F/R is supplied from a control circuit (not shown in drawing). Rotating direction signal F/R indicates the movement direction of scanning unit 3 in positioning "F" for the forward direction and in positioning "R" for the reverse direction, that is, switch 45 is changed from one state to another.

Herein, the operation of controllers 53, 54, and 55 is described.

In controller 53, first F-V converter 59 converts the frequency of first reference pulse train CM1 to a voltage signal when receiving first reference pulse train CM1 from reference signal generator 44. This voltage signal indicates a desirable rotation speed of electric motor 51, which is then supplied to arithmetic circuit 60.

Second F-V converter 61 converts pulse train P1 to a voltage signal which is supplied to arithmetic circuit 60. This voltage signal indicates a rotation speed while electric motor 51 rotates.

On the other hand, in controller 53, up-count terminal U of counter 62 receives first reference pulse train CM1, while down-count terminal D thereof receives pulse train P1. Counter 62 is incremented by first reference pulse train CM1, and is decremented by pulse train P1, thus the output signal from counter 62 indicates the difference in the number of pulses between first reference pulse train CM1 and pulse train P1. This output signal is supplied to D-A converter 63 to be converted to an analog signal. This analog signal indicates the turning position difference for revolutions of electric motor 51. In other words, it indicates the turning position error of photoconductive drum 10, which is then supplied to arithmetic circuit 60.

In arithmetic circuit 60, the voltage signal from first F-V converter 59, which indicates the desirable rotation speed is added to the analog signal from D-A converter 63, which indicates the turning position difference. This sum is subtracted by the voltage signal from second F-V converter 61, which indicates the actual rotation speed. Accordingly, Arithmetic circuit 60 generates control signal which is supplied to amplifier 58. Amplifier 58 amplifies to generate a first driving signal. This first driving signal is supplied to electric motor 51 to rotate photoconductive drum 10.

In controller 54, it is apparent that the operation is similar to controller 53 as shown in FIG. 4, therefore, the details of this description is omitted. In this case amplifier 58 generates a third driving signal which is supplied to electric motor 52 to rotate transfer drum 15.

Accordingly, first reference pulse train CM1 is supplied to both up-count terminals U of counters 62 and both first F-V converters 59 incorporated in controllers 53 and 54, respectively, therefore both electric motors 51 and 52 synchronously rotate each other.

The operation of controller 55 is very similar to that of controllers 53. In this case, first reference pulse train CM1 is also supplied to up-count terminal U of counter 62 and first F-V converter 59, electric motor 39 rotates in relation with the rotation speed of electric motors 51 and 52 so that scanning unit 3 harmoniously moves with the rotations of photoconductive drum 10 and transfer drum 15.

The operation of controller 55 depends on the position of switch 45. When switch 45 is positioned at "F" by rotating direction signal F/R, scanning unit 3 moves toward the direction of arrow A in response to a second driving signal outputted from amplifier 58, in which the movement speed of scanning unit 3 is synchronized with the peripheral speed of photoconductive drum 10 as well a transfer drum 15 in copying mode so that first reference pulse train CM1 is supplied to up-count terminal U of counter 62 as well as controllers 53 and 54. When switch 45 is positioned in "R" by rotating direction signal F/R, reference pulse train P4 is supplied to up-count terminal U and first F-V converter 59 to move scanning unit 3 toward the direction of arrow B in response to second driving signal in return mode. At this time, the frequency of reference pulse train P4 is higher than that of first reference pulse train CM1, therefore, the frequency of the second driving signal is higher than that of the signal in copying mode, so that the speed of electric motor 39 in returning mode is faster than the speed in copying mode, thus, scanning unit 3 is rapidly returned to the starting position thereof.

Heretofore, the copying machine control apparatus has been described for color copying machine having photoconductive drum 10 and transfer drum 15. This copying machine control apparatus can also be used for a monochromic copying machine. The monochromic copying machine is described later Accordingly, first reference pulse train CM1 is supplied to controllers 53, 54, and 55 to control the rotation speed and the turning position difference of electric motors 51, 52, and 39, so that the rotation of photoconductive drum 10 and transfer drum 15 can be synchronized to each other, and the movement of scanning unit 3 can be harmonized with the rotation of photoconductive drum 10 and transfer drum 15. In addition, the starting position of photoconductive drum 10, transfer drum 15, and scanning unit 3 can be harmonized each other, when starting in the copying mode.

Figure 5:
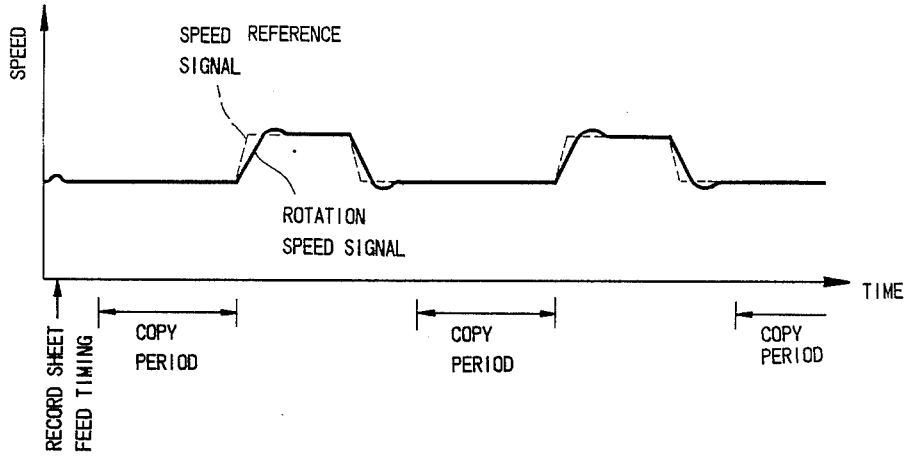
FIG. 5 is a graph showing a characteristic of the rotation speed reference signal and the measuring speed of the electric motor used for transfer drum.
Figure 3:
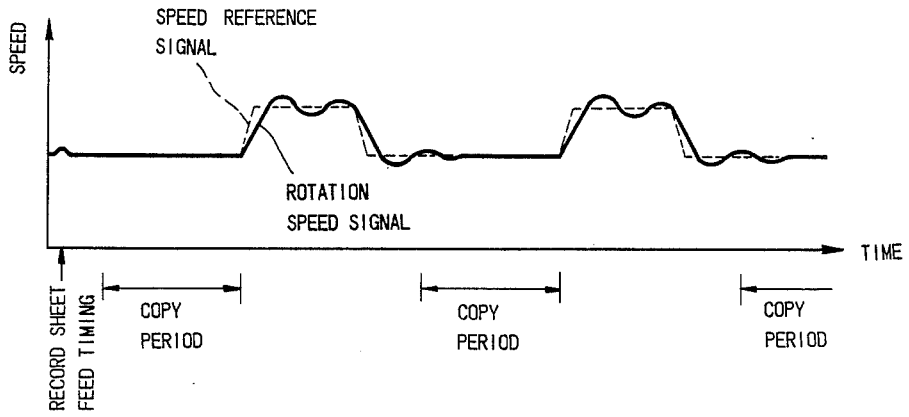
FIG. 3 (PRIOR ART)
FIG. 3 is a graph showing the conventional characteristic of the rotation speed reference signal and the measuring speed of the electric motor used for transfer drum.

Both electric motors 51 and 52 are of the outer-rotor type, each outer peripheral surface of which is fixedly or rigidly attached to the inner peripheral surface of photoconductive drum 10 and transfer drum 15, so that torsional variation is reduced when the developing device contacts to or disengages from the photoconductive drum 10. Thus, as shown in FIG. 5, the rotation speed signal of transfer drum 15 (as shown by the solid line) is stable in response to a speed reference signal (as shown by the broken line).

The use of the outer-rotor type electric motor reduces several components such as couplings, rotating shafts, and the like, so that the rigidity of the rotating component increases to obtain a stable speed and positioning of the rotation without positioning error, thus, both photoconductive drum 10 and transfer drum 15 can withstand rapid rotation.

In the monochromic copying machine, the copying machine only has a photoconductive drum 10, Thus this copying machine control apparatus comprises photoconductive drum 10, controller 53, reference signal generator 44, scanning unit 3, controller 55, and reference signal generator 46. Accordingly first reference pulse train CM1 is supplied to up-count terminals U of counters 62 and first F-V converters 59 incorporated in controllers 53 and 55 in copying mode, therefore electric motor 39 rotates in relation with the rotation speed of electric motor 51 so that scanning unit 3 harmoniously moves with the rotation of photoconductive drum 10 When reference pulse train P4 is supplied to controller 53 in the returning mode, the movement speed of scanning unit 3 is faster than the speed thereof during copying mode.

Accordingly, first reference pulse train CM1 is supplied to controllers 53 and 55 to control the rotation speed and the turning position difference of electric motors 51 and 39, so that the rotation of photoconductive drum 10 and the movement of scanning unit 3 can be harmonized with each other.

Electric motor 51 is the outer-rotor type, the outer peripheral surface of which is fixedly or rigidly attached to the inner peripheral surface of photoconductive drum 10, so that the similar effect can be achieved as the above-described.

As a result, the front edges of the toner image and record sheet are always harmonized, which eliminates an elongation, shortening, or misalignment during the copying process.

The preferred embodiment described herein is illustrative and not restrictive; the scope of the invention is indicated by the appended claims and all variations which fall within the claims ar intended to be embraced therein.

What is claimed is:

1. In a copying machine control apparatus, said control apparatus comprising:

photoconductive drum driven rotatively by a first driving means to form an electrostatic latent image corresponding to an original;

scanning means provided movably with an operation of said photoconductive drum in a linear to and fro direction along the original and driven by a second driving means to apply illumination thereto;

first control means for supplying a first driving signal to said first driving means, in which said first driving signal is composed of frequency difference between a first reference pulse train for actuating said first driving means and a pulse train indicated by number of revolutions outputted from a first pulse encoder coupled to said first driving means;

second control means for supplying a second driving signal to a second driving means to operate said scanning means, in which said second driving signal is composed of a frequency difference between said first reference pulse train for actuating said second driving means and a pulse train indicated by number of revolutions outputted from a second pulse encoder coupled to said second driving means;

switching means for changing said first reference pulse train to a second reference pulse train to generate said second driving signal, in which a frequency of said second reference pulse train is higher than that of said first reference pulse train;

position controller provided in said first and second control means to generate a position control signal so that number of revolutions of said first and second driving means are harmonized w!the said first reference pulse train, in which said position control signal is composed of a deviation between a total number of said first reference pulse train and each total number of said pulse trains outputted from said first and second pulse encoders, respectively;

speed controller provided in said first and second control means to generate a speed control signal which is composed of a frequency difference between a frequency of said first reference pulse train and each frequency of said pulse trains outputted from said first and second pulse encoders, respectively, and said speed controller adds said speed control signal to said position control signal to generate a driving signal which actuates said first and second driving means, respectively.

2. An control apparatus according to claim 1 wherein said first driving means has an outer rotor which rotates about a stator, an outer peripheral surface of said outer rotor is rigidly attached to an inner peripheral surface of said photoconductive drum.

3. In a copying machine control apparatus, said control apparatus comprising:

photoconductive drum driven rotatively by a first driving means to form an electrostatic latent image corresponding to an original;

scanning means provided movably in a linear to and fro direction along the original and driven by a second driving means to apply illumination thereto;

transfer drum driven rotatively by a third driving means to receive the electrostatic image from said photoconductive drum;

first control means for supplying a first driving signal to said first driving means, in which said first driving signal is composed of a frequency difference between a first reference pulse train for actuating said first driving means and a pulse train indicated by number of revolutions outputted from a first pulse encoder coupled to said first driving means;

second control means for supplying a second driving signal to said second driving means to operate said scanning means, in which said second driving signal is composed of a frequency difference between said first reference pulse train for actuating said second driving means and a pulse train indicated by number of revolutions outputted from a second pulse encoder coupled to said second driving means;

third control means for supplying a third driving signal to a third driving means to operate said transfer drum, in which said third driving signal is composed of a frequency difference between said first reference pulse train for actuating said third driving means and pulse train indicated by number of revolutions outputted from a third pulse encoder coupled to said third driving means;

switching means for changing said first reference pulse train to a second reference pulse train to generate said second driving signal, in which a frequency of said second driving signal is higher than that of said first driving signal;

position controller provided in said first, second, and third control means to generate a position control signal so that number of revolutions of said first, second, and third driving means are harmonized with said first reference pulse train, in which said position control signal is composed of a deviation between a total number of said first reference pulse train and each total number of said pulse train outputted from said first, second, and third pulse encoders, respectively;

speed controller provided in said first, second, and third control means to generate a speed control signal which is composed of a frequency difference between a frequency of said first reference pulse train and each frequency of said pulse trains outputted from said first, second, and third pulse encoders, respectively, and said speed controller adds said speed control signal to said position control signal to generate a driving signal which actuates said first, second, and third driving means, respectively.

4. A control apparatus according to claim 3 wherein said each of first and third driving means is electric motor having an outer rotor which rotates about a stator, an outer peripheral surface of said outer rotor is rigidly attached to an inner peripheral surface of both said photoconductive and transfer drums, respectively.

* * * * *

UNITED STATES PATENT AND TRADEMARK OFFICE
CERTIFICATE OF CORRECTION

PATENT NO. : 4,947,209

DATED : August 7, 1990

INVENTOR(S) : Satoru Maeno, et al

It is certified that error appears in the above-identified patent and that said Letters Patent is hereby corrected as shown below:

Column 1, line 25: "from" should read as --fro--

Column 2, line 11: "fixin" should read as --fixing--

Column 3, line 11: "o" should read as --on--

Column 4, line 22: "between first" should read as --between a first--

Column 5, line 9: "of" should read as --for--

Column 8, line 34: "for color" should read as --for a color--

Column 9, line 11: "10 When" should read as --10. When--

Column 9, line 47, Claim 1: "of frequency" should read as --of a frequency--

Column 10, line 1, Claim 1: "w!the" should read as --with--

UNITED STATES PATENT AND TRADEMARK OFFICE

CERTIFICATE OF CORRECTION

PATENT NO. : 4,947,209

DATED : August 7, 1990

INVENTOR(S) : Satoru Maeno, et al

It is certified that error appears in the above-identified patent and that said Letters Patent is hereby corrected as shown below:

Column 11, line 2, Claim 3: "train" should read as --trains--

Signed and Sealed this

Fifth Day of November, 1991

*Attest:*

HARRY F. MANBECK, JR.

*Attesting Officer*

*Commissioner of Patents and Trademarks*